United States Patent [19]

Smith

[11] 3,934,919

[45] Jan. 27, 1976

[54] SELF-ERECTING MATERIAL HANDLING SLING

[75] Inventor: Arthur W. Smith, Trenton, N.J.

[73] Assignee: TransTechnology Corporation, Sherman Oaks, Calif.

[22] Filed: May 7, 1974

[21] Appl. No.: 467,652

[52] U.S. Cl. ..... 294/74; 294/81 R; 224/49

[51] Int. Cl.[2] ..... B66C 1/18

[58] Field of Search ..... 294/67 E, 67 EA, 74–77, 294/78 R, 81 R, 83 R; 9/11 A, 14; 46/87–90; 52/2; D34/15 DD; 206/522; 214/10.5 D; 224/45 D, 45 E, 45 N, 49, 52, 54, 58

[56] References Cited

UNITED STATES PATENTS

| | | | |
|---|---|---|---|
| 2,449,591 | 9/1948 | Couse | 206/522 X |
| 3,056,624 | 10/1962 | Nardone | 294/83 R |
| 3,092,854 | 6/1963 | Manhart | 9/11 A |
| 3,176,327 | 4/1965 | Oberth | 9/14 |
| 3,364,632 | 1/1968 | Isaac | 52/2 |
| 3,548,904 | 12/1970 | Mackell | 52/2 X |
| 3,608,250 | 9/1971 | Ducrocq | 52/2 |
| 3,765,543 | 10/1973 | Thomas | 294/74 X |
| 3,829,144 | 8/1974 | Nattrass | 294/74 |

*Primary Examiner*—James B. Marbert
*Assistant Examiner*—Johnny D. Cherry
*Attorney, Agent, or Firm*—Synnestvedt & Lechner

[57] ABSTRACT

A material handling sling comprising a main elongated, flexible, securing member, fluid inflatable means integral with the main securing member and positioned intermediate the leading and terminal ends thereof. The sling may also include a secondary securing member that is attached to the main securing member at two points intermediate the ends of the inflatable means, one point being inward the end of the inflatable means nearest the leading end of the main securing member and the other point being inward the end of the inflatable means nearest the terminal end of the main securing member; the secondary securing member being adapted to provide a working length spanning the distance between the two points of attachment of the secondary securing member to the main securing member that is shorter than the length of the main securing member between said two points.

16 Claims, 13 Drawing Figures

#2
#1

SELF-ERECTING MATERIAL HANDLING SLING

This invention relates to a cargo or material handling sling, i.e., an elongated, flexible, securing member such as a strap, band, belt, rope, cable, web or the like that is used to securely hold an article (hereinafter sometimes referred to as the cargo or the cargo load) that is to be hoisted, lowered, carried or suspended by various cargo transfer mechanisms (hereinafter sometimes collectively referred to as cranes) that employ tackle to move a hook member (vertically and/or horizontally) that is adapted for engagement with the sling during successive transfer operations between various storage and transport facilities.

In using a conventional cargo sling it is necessary for a floor man to manually engage and disengage the crane hook and the sling each time a new load is to be received and moved by the crane in a transfer operation, or, where the crane hook has a fixed beam, whenever the load is to be discharged.

It is an object of this invention to provide a new and novel type of sling which when once secured to the cargo load will maintain itself in an erect position so that the sling can be automatically engaged by (or disengaged from) the crane hook merely by the crane operator's maneuvering his machine from his normal operating station and without the necessity of having a floor man to manually connect (or disconnect) the hook and sling.

It is another object of this invention to provide a self-erecting sling that can be readily deflected from its operating or erect position (for example, by stacking a second load unit on top of a first load unit to which the sling has been secured) and which will return to its operating position when the deflecting force is removed.

It is still another object of this invention to provide a self-erecting sling that can be adjustable to accommodate loads of different sizes and shapes.

A further object of the invention is to provide a new system for transferring cargo utilizing the novel sling provided for hereinafter.

These objects and advantages are obtained in accordance with the invention by a sling assembly that has a fluid inflatable bail and more specifically by a material handling sling comprising a main elongated, flexible, securing member, fluid inflatable means integral with the main securing member and positioned intermediate the leading and terminal ends therof. The sling may also include a secondary securing member that is attached to the main securing member at two points intermediate the ends of the inflatable means, one point being inward the end of the inflatable means nearest the leading end of the main securing member and the other point being inward the end of the inflatable means nearest the terminal end of the main securing member; the secondary securing member being adapted to provide a working length spanning the distance between the two points of attachment of the secondary securing member to the main securing member that is shorter than the length of the main securing member between said two points.

For a better understanding of the invention, its advantages and the specific objects obtained with its use, reference should be made to the accompanying drawings and descriptive matter in which there is illustrated and described various presently preferred embodiments of a material handling sling made in accordance with this invention.

Figures 1, 2, 2A, 2B, 3, 4:
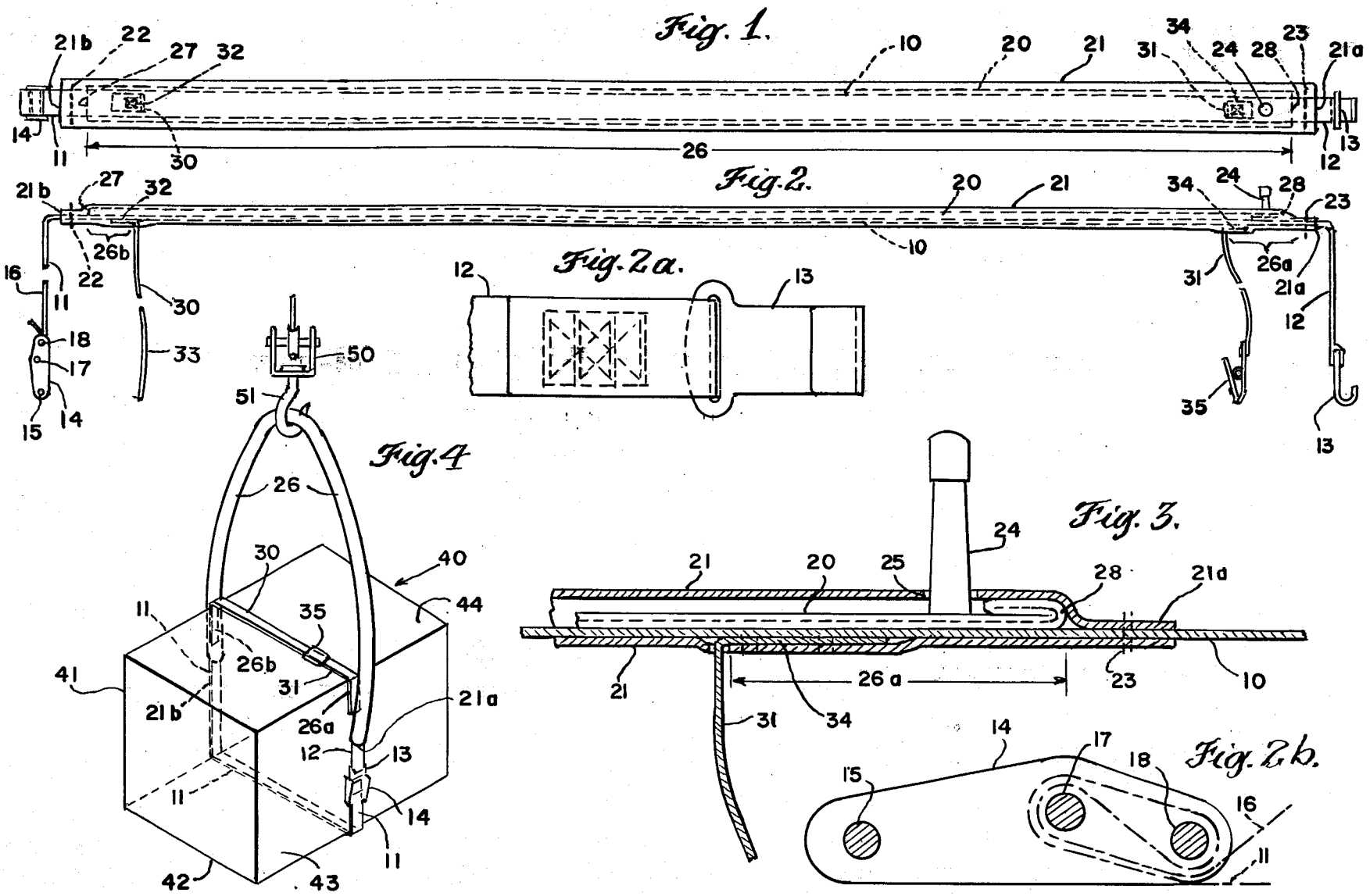
FIG. 1 is a plan view of a strap type sling according to the present invention.
FIG. 2 is an elevational view of the strap type sling of FIG. 1.

FIG. 2*a* is an enlarged plan view of a flat hook end fitting that can be used with the sling.

FIG. 2*b* is an enlarged sectional elevation of a double bitted friction grip end fitting that can be used with the sling.

FIG. 3 is an enlargement of the righthand portion of the sling illustrated in FIG. 2 to illustrate the valve and inflatable bladder.

FIG. 4 is an isometric view illustrating the sling of FIG. 1 in use in handling a load.

Figures 5, 6, 7, 8:
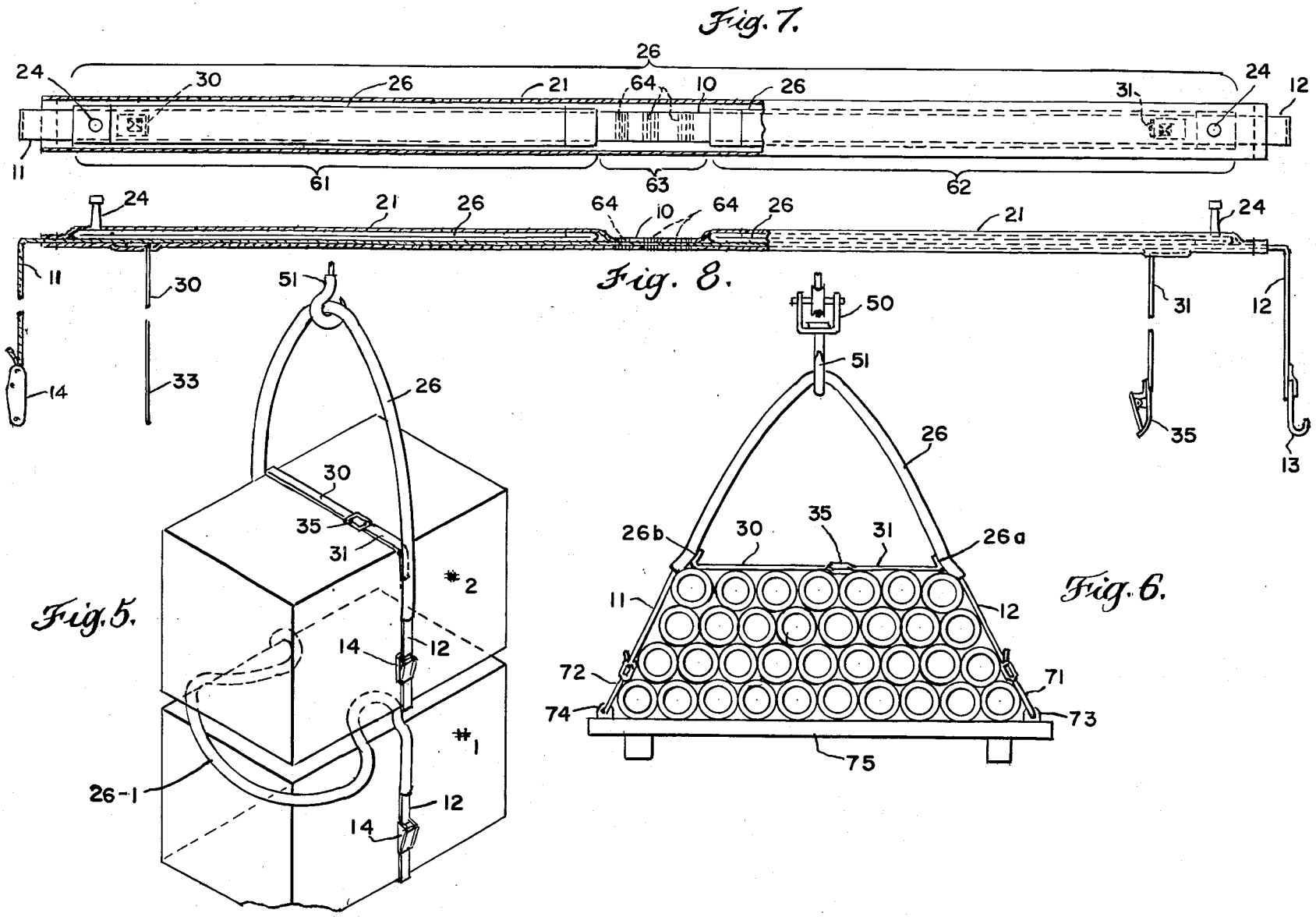

FIG. 5 is an isometric view of a sling of this invention being used to stack unitized cargo and to illustrate the deflectability of the sling bail member when a second load is placed on top a first load to which the sling is still affixed.

FIG. 6 is an elevational view illustating use of a sling made in accordance with the present invention for lifting a load carried on a pallet.

FIG. 7 is a plan view of another embodiment of a strap type sling made in accordance with the present invention.

FIG. 8 is an elevational view of the strap type sling of FIG. 6.

Figure 9:
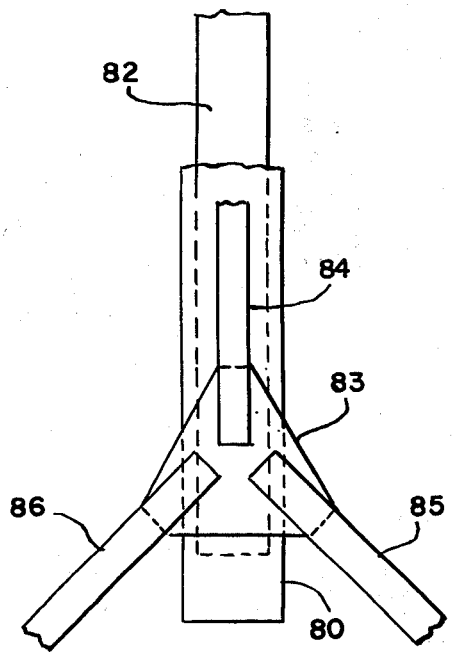
Figure 9A:
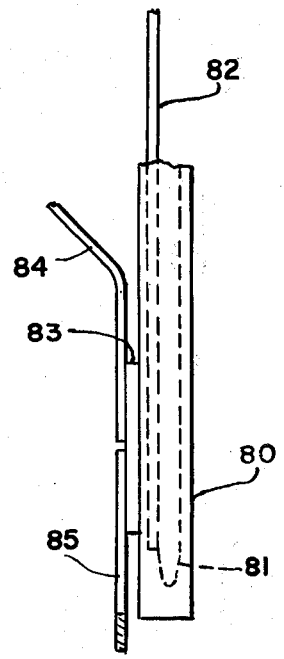

FIGS. 9 and 9*a* are plan and side views respectively of the yoke portion of a modified sling made in accordance with this invention.

Figure 10:
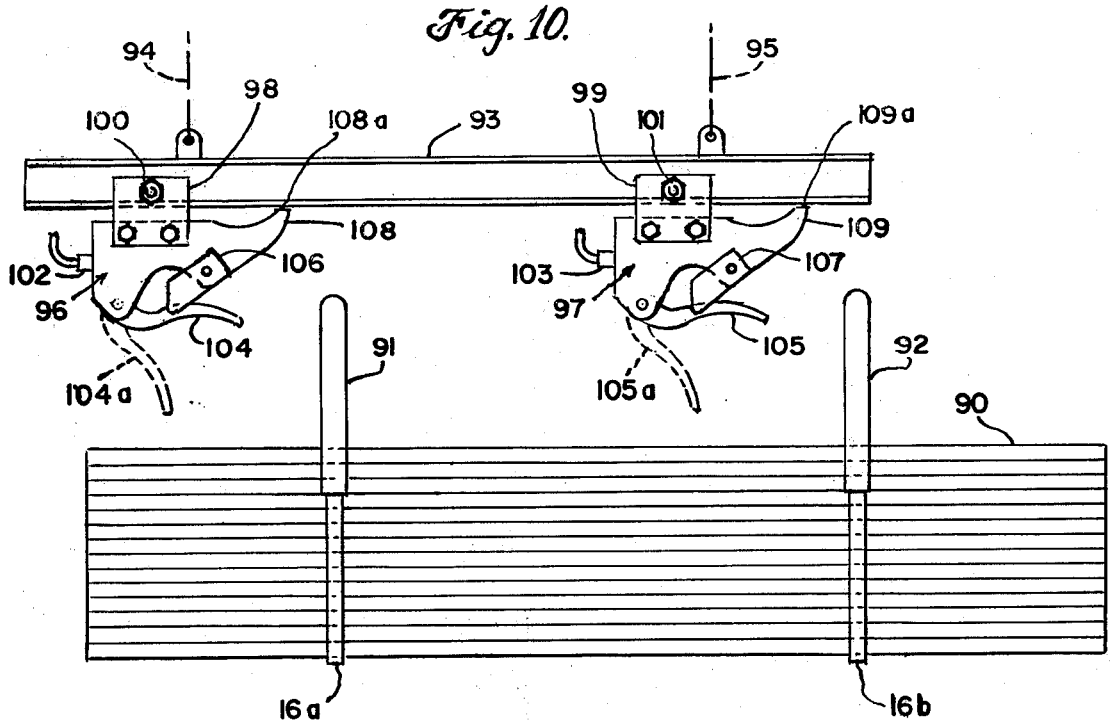

FIG. 10 illustrates the use of slings of this invention in the transferring of extra long loads.

As shown in FIG. 1, 10 is the main strap of the sling. It is, in this embodiment, made of fabric webbing strap of suitable length, gauge and width for the handling of the cargo load and acts as the main securing member. For convenience, end 11 of strap 10 is designated as its leading end, and end 12 is designated as its terminal end.

Any type of matable end fittings can be used on the strap that will enable the strap to be coupled together to form a continuous belt or which enables the strap to be secured to a load support. In the simplest embodiment no end fittings are employed and the strap ends are merely tied to form the endless belt. In the embodiment illustrated in FIGS. 1 and 2, a flat hook or J-hook 13 is secured to the terminal end 12 and a double-bitted friction grip fitting 14 is carried by the leading end 11; such a friction fitting includes a cross member 15 that is adapted to be engaged by the flat hook 13 and thereby form strap 10 into an endless belt. The free strap end 16 is threaded through the bitts 17, 18 in a known manner, as shown in FIG. 2*b*, and this arrangement permits rough adjustments of the length of strap 10. One strap end is usually longer than the other end as it is intended that the longer strap section pass beneath the cargo load and permit buckling or connecting the strap ends at the side of the load rather than under the load. In the illustrated embodiment the leading end 11 is considerably longer than the terminal end 12 and excess strap length is taken up manually with the friction grip end fitting.

An elongated bladder or other fluid inflatable means 20 is positioned intermediate the leading and terminal ends of the main securing member — strap 10. Many types of fluid inflatable means can be used for the purposes of this invention. However, in the illustrated embodiments the inflatable means 20 is the inner tube of a bicycle tire. It is arranged to extend lengthwise along a portion of the strap 10 that is to act as a bail and is held in close association with strap 10 by a sleeve or tube member 21 that either surrounds both the strap 10 and bladder 20 or that is secured to strap 10 — in which case the bladder only is positioned in the sleeve. In the illustated embodiment, the sleeve surrounds both the strap and the inner tube. The ends 21*a* and 21*b* of sleeve 21 are secured in a suitable manner to strap 10 to prevent lateral and transverse movement of the sleeve 21 relative to the strap 10 and also to immobilize the inner tube 20 in a pocket formed between the sleeve and strap. In the illustrated embodiments the sleeve is a fabric material and the ends of the sleeve are merely stitched 22, 23 to strap 10. A valve 24 for introducing compressed air or other fluid into the inner tube 20 projects through a suitably positioned opening 25 in sleeve 21.

Where an inner tube such as the bicycle tire inner tube is employed as the fluid inflatable means, it can either be cut and the cut ends sealed in any known manner; this will form an elongated inflatable tube, or the circular inner tube can be simply flattened and installed in the pocket as a double tube thickness without cutting. A plurality of tubes can be positioned in the inflatable section to provide an inflatable bail of the desired length. It is to be understood that other fluid inflatable devices can be employed in lieu of the illustrated inner tube.

It is intended that the sling be used in combination with a secondary securing element that can draw the legs of the bail section together, for example, a secondary strap or securing element that can pass over the top of the cargo load and that extends from a point inboard the end of the inflatable means that is nearer to the leading end of the main securing member to a point that is inboard the end of the inflatable means that is nearer the terminal end of the main securing member. The secondary securing element has an effective working length (when it is connecting the two aforesaid points) that is shorter than that of the main securing member between the said two points. The secondary securing element can be any device that can position or draw the ends of the main strap section that includes the inflatable means (hereinafter sometimes called the inflatable section 26, or the sling bail) towards one another and cause the longer inflatable section, if and when it is in uninflated condition, to assume a bowed or angular configuration. Thus the securing element can be a bar, wire, strap or the like that either is somewhat shorter than the total length of the inflatable section 26 (or that can be shortened to provide a shorter length than the total length of the inflatable section 26) and that can be connected directly or indirectly to the main securing member at points inwardly of the extreme ends 27, 28 of the inflatable section.

In the embodiment illustrated in FIGS. 1, 2, 3 and 4, the securing element or secondary securing means is in the form of a secondary strap or belt of adjustable working length. The secondary strap is formed of two strap elements 30, 31. One end of strap element 30 is secured to the main securing member or strap 10 at a point 32 inward end 27 of the inflatable section 26; strap element 30 also includes a "free end" 33. One end of the second strap element 31 is secured to the main securing member or strap 10 at a point 34 inward end 28 of the inflatable section 26; the unsecured end of strap element 31 carries a buckle 35 adapted to engage and hold the free end 33 of strap element 30. In the illustrated embodiment the secured ends of strap elements 30, 31 are stitched to the main strap 10 and to the sleeve 20. The strap elements pass through suitable openings in the sleeve 20 that surrounds the inflatable section. Since the sleeve and main strap are immobilized relative to one another, it is also contemplated that the ends could merely be secured to the sleeve rather than to the main strap and the sleeve.

FIG. 4 illustrates the use of the sling shown in FIG. 1 in a cargo transfer operation involving a unitized cargo load 40 in a rectangular container.

In the sling embodiment illustrated in FIG. 1, the leading end 11 is longer than the terminal end 12 which includes only a fairly short length of strap extending beyond the end 21*a* of sleeve 21. In use, the bail is usually on the top of the load and the leading end 11 of the main strap is positioned so that it runs down one side 41 of the load 40, passes under the bottom 42 of the load and starts a run up the opposite side 43 of the load and is connected with the terminal end 12 of the main strap by the mating end fittings 14 and 13. The secondary or auxiliary strap elements 30, 31 pass over the top 44 of the load from opposite sides and are buckled together to completely and securely belt the cargo load. In order to provide lateral support for the bail 26, the bail leg portions 26*a*, 26*b*, (i.e., the bail portions that extend generally from the points of attachment 32, 34 of the secondary strap elements and the main strap to the outer ends of the inflatable bladder or tube 27, 28) must be drawn firmly against and supported and stabilized by the sidewalls of the load itself or other rigid vertically extending support member. The leg portions 26*a* and 26*b* must be of sufficient length so that the inflatable section 26 that forms that bail will stand in an erect upright position when the bladder and leg portions are inflated with compressed air or other fluid — i.e., the leg portions must be immobilized for sufficient length to stabilized and provide rigidity to the bail; with a 1 ¾ inch tube diameter bicycle tire for a 28 inch diameter wheel inflated to between 15–25 p.s.i., the leg length needed to give the desired stability is at least about two to three times the inflated diameter of the inflatable section.

The sling can be assembled about the load with the bail either in an inflated or deflated condition. If the bail section is inflated, the bail is laid across the top of the load, the main strap is passed around the long and is preferably secured at one side of the cargo load, the inflated bail will move into an upright or operating position when the strap elements that form the secondary securing member are passed over the top of the load and drawn together. If the bail is in a deflated condition the main and secondary straps are secured as aforesaid and the bail will raise itself to the erect operating position when compressed air or other fluid is introduced therein.

Because the bail stands in an erect or upright position once the sling has been connected to the load, it is possible for the crane operator to carry out cargo transfer operations without the need of further manual assistance at the load itself. The cargo transfer operations can be fully controlled from the operator's station by moving the hoist block 50 vertically and horizontally to bring it into a position so that he can maneuver the hook 51 to engage the bail; once engaged the cargo can be raised, transferred to the desired location, and the hook can be disengaged from the bail by merely lowering the hoist block to a point where there is no load on the beam of the hook and then horizontally moving the hook to completely disengage it from the bail. All such movements can be carried out by the crane operator from his control station and without manual assistance at the hook.

Because the bail is inflated with fluid it can be readily deflected from its erect or operating position but will return to the erect position once the deflecting force has been removed. This permits the close stacking of unitized cargo loads without removing the sling, as is illustrated in FIG. 5. Thus when Cargo Unit No. 2 is lowered for stacking on Cargo Unit No. 1, the bail 26-1 will be deflected from its upright position or flattened to lie along the top of Cargo Unit No. 1. When Cargo Unit No. 2 is lifted off Cargo Unit No. 1, the bail 26-1 of Cargo Unit No. 1 will automatically return to its erect operating position.

As shown in FIG. 6, the sling can be used to handle palletized loads by connecting suitable end fittings 71, 72 on the leading 11 and terminal 12 ends of the main strap to appropriate matable fittings 73, 74 on the pallet 75 or other load supporting means. The secondary strap elements 30, 31 pass over the top of the load and are buckled at 35 to draw the legs **26*a*, 26*b* of the bail 26 tightly against a vertically extending side portion of the load to stabilize and rigidify the bail. It should be noted that the sides of the load are not perpendicular to ground level; nevertheless they stabilize the bail legs and provide sufficient rigidity to the bail to permit it to function in the same manner as in the embodiments in FIGS. 4 and 5.**

FIGS. 7 and 8 illustrate an embodiment of the invention in which the bail section 26 includes two inflatable sections 61, 62 of approximately equal length and separated at the middle of the bail section by an uninflatable section 63 formed by portions of the main strap 10 and the sleeve 21. Stitching 64 immobilizes the main strap 10 and the sleeve 20 in the noninflatable bail section 63. Other features of this sling embodiment are the same as in the FIG. 1 embodiment and the same reference numerals are used to designate the structural or functional counterparts in both embodiments.

When the sling of FIGS. 7 and 8 is used on a cargo load, and if the bladders of sections 61, 62 are inflated, the bail will stand in an erect operating position and it is contemplated that the hoist block hook will engage the uninflated section 63 which should be positioned so that it is at the peak portion of the bail V or arch.

An advantage of the embodiment shown in FIGS. 7 and 8 lies in its fail-safe capability, since the bail will stand erect even if only one of the inflatable sections 61 or 62 is inflated and inadvertent loss of fluid from one section will not cause collapse of the bail.

FIGS. 9 and **9*a* illustrate a further variation of a sling made in accordance with this invention that is especially useful when handling pallet carried loads or lifting loads carried on a rigid supporting member. The leading end of the main support or strap near the end of the inflatable section is bifurcated to form two strap sections that can be attached through suitable end fittings to the pallet spaced points to stabilize the load carrying platform. The terminal end of the main strap is similarly bifurcated. With reference to FIGS. 9 and 9*a* (which could represent either end of the unit), the end of the sleeve 80 that houses both the inner tube 81 (only shown in FIG. 9*a*) and the strap or main securing member 82 are secured to gusset member 83. On the opposite face of the gusset, the ends of three auxiliary strap portions 84, 85 and 86 are secured in inverted Y shape arrangement. Auxiliary strap 84, corresponds to the base leg of the Y and extends in a generally parallel direction to the main strap 82. Auxiliary strap 84 functions in the same manner as the secondary securing member 31 in the FIG. 1 embodiment. Auxiliary straps 85 and 86 are the arms of the Y and on their free ends they carry pallet hooks or other suitable end fittings (not shown) enabling the auxiliary straps 85 and 86 to engage the pallet or to be connected to mating fittings along one side of the load or the base support. Although strap 84 must be interconnected with the main securing member at a point inward from the end of the inflatable section so as to draw the bail leg against the load to stabilize the bail, the auxiliary strap 85, 86** can join and be secured to the main strap at a point on the main strap outwardly of the end of the inflatable section.

FIG. 10 illustrates a transfer system utilizing a plurality of slings made according to the invention in the lifting of very long loads and especially of flexible materials that would bend unduly if lifted by a single sling surrounding the load at the center of gravity.

Referring to FIG. 10, the load 90 consists of a bundle of very long, small cross-section relatively thin-walled aluminum extrusions. It is contemplated that many such bundles of the same dimensions are to be transferred from station to station in a warehouse. Slings of the type illustrated in FIG. 1 are positioned on the load at points along the load that will provide the needed support to prevent objectionable bending of the extrusions. In the embodiment illustrated only two slings are utilized, but any number can be used so as to keep the load from bending. The main strap **16*a*, 16*b* passes underneath and around the bundle and the inflated bail 91, 92 stands in an erect position above the load. A strongback 93, for example an I beam, is suspended from the cables 94, 95** of an overhead double lift crane (not shown). The strongback carries two or more automatic loading cargo release hooks (for example, the type of hook illustrated in U.S. Pat. No. 3,068,034); these hooks can be operated by remote control from the crane operator's control station to open and/or close the beam. Other remote control mechanisms can also be provided to laterally space the hooks along the strongback to correspond to the spacing of the slings.

In the FIG. 10 embodiment, two cargo release hooks 96 and 97 are suspended from the strong back 93 by means of slideable brackets 98, 99. Tightening of the bracket bolts 100, 101 can maintain the position of hooks on the strongback; i.e., in spaced apart positions on the strongback the same distance as the slings are spaced on the load. Connections for the remote control mechanism running to the cab can be seen at 102, 103.

In use, once the slings have been installed on a given bundle, it is possible for the crane operator in his overhead cab to transfer the load from station to station without further assistance from the floor man. To pick up a load, the crane operator must first maneuver and align the stronback so that it extends generally parallel to the load and so that the hook beams 104, 105 of the hooks are slightly below the apex of the bails 91 and 92. Then by lateral maneuvering of the strongback, the cargo hooks 96, 97 can be made to engage the bails 91, 92. Once a given hook and bail have become engaged, the keeper 106, 107 will maintain the engagement until the beam is released. To assist in guiding the bail into the hook beam slot an upwardly curved nose member 108, 109 projects from the hook above the beam slot in the direction of the hook beam. The tip of the nose 108*a* and 109*a* is in very close proximity to the underside of the strongback so as to prevent the bail from inadvertently slipping between the top of the hook and the bottom of the strongback. Because of the deflectability of the bail, it is not essential that precise vertical alignment between the hook beam and bail apex be obtained before moving the strongback laterally; if the hook is too low the nose piece will engage and deflect the bail and guide it into the beam slot. Similarly the deflectability of the bail permits some lateral deviation in the spacing of the slings. Thus, if there is a minor difference in the spacing of the hooks and slings, one hook can be connected to its bail and that bail can be deflected backwards and forwards while the crane operator meneuvers the strongback in "fishing" to engage the second hook and bail.

Where a cargo hook that can be both opened and closed by remote control is used, the initial vertical alignment of the hook beam and bail apex need not be too precise. Thus if the hook beams are in their open position 104*a*, 105*a* in fishing for the bail, once contact with the bail has been made with the open downwardly depending hook beam, the crane operator can actuate the control mechanisms to close the beam. The beam is so contoured that on closing it steers the bail into the beam slot to connect the crane hook to the load.

I claim:

1. A material handling sling comprising an elongated, flexible securing member having a leading end and a terminal end, fluid inflatable means disposed intermediate the leading and terminal ends of the securing member, said inflatable means being adapted to increase the rigidity of the portions of the securing member with which it is in contact when said means are inflated with a fluid and thereby form a bowed or angular bail that projects outwardly from the load.

2. A material handling sling according to claim 1 wherein the leading and terminal ends of the securing member are provided with end fittings.

3. A material handling sling according to claim 2 wherein the end fitting on the terminal end is matingly engageable with the end fitting on the leading end.

4. A material handling sling according to claim 3 wherein the end fittings are matingly engageable with fittings carried by a load or by a load support.

5. A material handling sling according to claim 2 wherein the leading and terminal end portions of the securing member extending outwardly from the inflatable means include a plurality of separate enlongated, flexible securing elements that converge with the securing member and are connected thereto in the vicinity of the outermost end portions of the inflatable means or at a point on either securing member outwardly therefrom.

6. A material handling sling according to claim 1 wherein the leading and terminal end portions of the securing member extending outwardly from the inflatable means include a plurality of separate elongated, flexible securing elements that converge with the securing member and are connected thereto in the vicinity of the outermost end portions of the inflatable means or at a point on either securing member outwardly therefrom.

7. A system for transferring a cargo load by means of a crane having a movable suspended cargo hook and which comprises securing a sling according to claim 1 to the load to be transferred so that so that the bail, when inflated, will stand in erect position above the load and bringing the crane hook and sling bail into operating engagement with the inflated bail.

8. A system according to claim 7 wherein a plurality of slings are installed on the load to be transferred with the sling bails being spaced apart laterally in generally parallel planes, and wherein the bails are individually engaged by one of a plurality of cargo hooks carried on a strong back suspended from the crane.

9. A material handling sling comprising an elongated, flexible securing member having a leading end and a terminal end, fluid inflatable means disposed intermediate the leading and terminal ends of the securing member, a securing element extending from a point inward the end of the inflatable means that is nearer to the leading end of the securing member to a point inward the end of the inflatable means that is nearer to the terminal end of the securing member, said securing element having an effective working length when connecting said two points that is shorter than the length of the securing member between said two points.

10. A material handling sling comprising a main elongated, flexible securing member having a leading end and a terminal end and a secondary elongated, flexible securing member, fluid inflatable means integral with the main securing member and positioned intermediate the leading and terminal ends thereof, the secondary securing member being connected to the main securing member at two points intermediate the ends of the inflatable means, one point being inward the end of the inflatable means nearest the leading end of the main securing member and the other point being inward the end of the inflatable means nearest the terminal end of the main securing member, and the secondary securing member, when connected to the main securing member, being adapted to provide a working length spanning the distance between the two points of connection of the secondary securing member to the main securing member that is shorter than the length of the main securing member between said two points.

11. A material handling sling according to claim 10 wherein the main securing member is a strap.

12. A material handling sling according to claim 11 and including a securing element extending from a point inward the end of the inflatable means that is nearer to the leading end of the securing member to a point inward the end of the inflatable means that is nearer to the terminal end of the securing member, said securing element having an effective working length when connecting said two points that is shorter than the length of the securing member between said two points.

13. A material handling sling according to claim 11 wherein the secondary securing member is a strap.

14. A material handling sling according to claim 10 wherein the secondary securing member is a strap.

15. A material handling sling according to claim 10 wherein the working length of the secondary securing member can be varied.

16. A material handling sling according to claim 10 wherein the working length of the secondary securing member is fixed.

* * * * *